US007093978B2

(12) United States Patent
Tan

(10) Patent No.: US 7,093,978 B2
(45) Date of Patent: Aug. 22, 2006

(54) PRE-CUT PLASTIC BAG ROLL, METHOD AND APPARATUS FOR MAKING SAME

(76) Inventor: Gregorio Lim Tan, 412 Rue De la Riviere, Kenner, LA (US) 70065

( * ) Notice: Subject to any disclaimer, the term of this patent is extended or adjusted under 35 U.S.C. 154(b) by 0 days.

(21) Appl. No.: 10/850,485

(22) Filed: May 20, 2004

(65) Prior Publication Data

US 2005/0259892 A1 Nov. 24, 2005

(51) Int. Cl.
*B65D 30/00* (2006.01)

(52) U.S. Cl. ..... 383/37; 383/120

(58) Field of Classification Search ..... 383/37, 383/120, 8

See application file for complete search history.

(56) References Cited

U.S. PATENT DOCUMENTS

| | | | | |
|---|---|---|---|---|
| 2,973,697 A | | 3/1961 | Lemer | |
| 3,353,661 A | * | 11/1967 | Membrino | 206/526 |
| 3,960,062 A | | 6/1976 | Leloux | |
| 3,979,050 A | | 9/1976 | Cilia | |
| 4,120,716 A | * | 10/1978 | Bonet | 156/272.6 |
| 4,285,681 A | | 8/1981 | Walitalo et al. | |
| 4,500,307 A | | 2/1985 | Bridgeman | |
| 4,561,107 A | | 12/1985 | Herder | |
| 4,652,253 A | | 3/1987 | Benoit | |
| 4,747,815 A | | 5/1988 | Benoit et al. | |
| 4,802,582 A | | 2/1989 | Johnson | |
| 5,041,317 A | | 8/1991 | Greyvenstein | |
| 5,215,275 A | | 6/1993 | Gold | |
| 5,335,788 A | * | 8/1994 | Beasley et al. | 206/554 |
| 5,752,666 A | * | 5/1998 | Simhaee | 242/160.4 |
| 5,971,138 A | | 10/1999 | Soughan | |
| 6,135,281 A | * | 10/2000 | Simhaee | 206/390 |

FOREIGN PATENT DOCUMENTS

| | | | | |
|---|---|---|---|---|
| WO | WO 093011050 A | * | 6/1993 | 383/37 |

* cited by examiner

*Primary Examiner*—Jes F. Pascua
(74) *Attorney, Agent, or Firm*—David A. Belasco; Belasco Jacobs & Townsley, LLP

(57) ABSTRACT

A polyethylene produce bag roll includes a plurality of plastic film bags joined to one another with a perforation line. The perforation line is slit at least one end for a first predetermined distance to aid in tearing the bag from the roll. The perforation may also include a chisel cut to aid in removing bags from the roll in a dispenser equipped with a perforation parting means. The bags may be gusseted or ungusseted. Outer surfaces of the bags are corona treated to enhance adhesion of printing ink to the bags. The bag roll may be cored or uncored.

9 Claims, 3 Drawing Sheets

155
195
160
170
225
240
230
105
115
120
125
15
165
175
210
215
220
110
100
250
185
180
255
10
ABC STORES
20
115
105
15
100

PRE-CUT PLASTIC BAG ROLL, METHOD AND APPARATUS FOR MAKING SAME

FIELD OF INVENTION

The invention pertains to plastic bags. More particularly, the invention relates to plastic bags designed for fresh produce that are dispensed from compact rolls and designed to be easily opened.

BACKGROUND OF THE INVENTION

Plastic bags have found wide use in grocery markets and retail applications for transporting produce groceries and various other items. To be most useful for consumers plastic bags should incorporate a number of features. These features relate to the ease of use of the bags with respect to tearing them from a bag roll, opening them, placing goods inside, carrying them and dispensing them.

A variety of designs have been developed to meet these needs. U.S. Pat. No. 5,215,275, issued to Gold, is directed to a process for making a roll of plastic bags such as those used in the produce section of a supermarket. The plastic bag roll is made from a film extruded in the form of a tube and slit into two parallel faces. The two-ply web of material is then sub-divided into a series of interconnected plastic bags. The bottom of each bag is formed by a transverse seal extending from one side of the web to the other. Below seal, each ply of the web is perforated separately to prevent sticking. The perforation lines of the two plies coincide at the nips that facilitate tearing a bag from the roll. After perforation, the sides of the web are heat sealed to form the bag. The finished roll of bags is wound about a dowel or cardboard tube.

U.S. Pat. No. 4,652,253, issued to Benoit, is directed to a method for forming a roll of gusseted flat bottom thermoplastic bags. A tube of typically polyethylene film is collapsed and simultaneously gusseted yielding gussets that do not fully extend to the vertical center of the tube. A seal line and perforation line are then simultaneously formed. Triangular regions bounded by the sealed and severed line, the cut line and the edge of the gusset are then removed from the tube. The formed bags are wound into a roll interconnected at the perforation lines.

U.S. Pat. No. 5,971,138, issued to Soughan, is directed to a toiletry-dispensing package. A roll of envelopes formed of flexible polymeric moisture-resistant film material is shown. These envelopes are separated by perforation lines extending across the width of the roll. The end points of perforation line coincide with nips or cuts.

U.S. Pat. No. 4,802,582, issued to Johnson, is directed to a roll of continuous draw tape plastic bags. The bags are interconnected laterally by perforation lines bounded by side seals. The side welds of adjacent bag tape hems form a notch at the end point of the perforation line.

U.S. Pat. No. 4,747,815, issued to Benoit et al., is directed to a collection of thin thermoplastic bags meant for grocery produce. Lines of weakness are formed transversely across each film face for bag tear-off. Both faces of the bag have a series of similar perforations beneath the seal. In an alternate embodiment the front face of the bag has a series of perforations interrupted in the center by a slit approximately one-third the width of the bag. In another embodiment the perforations on the front bag face are interrupted by a cutout. Both the slit and the cutout accommodate opening of the bag mouth and removing the bag.

It is an objective of the present invention to provide plastic bags that can be easily stored on and dispensed from various roll dispensers. It is a further objective to provide bags that can be easily torn from a dispensing roll. It is a still further objective of the invention to provide bags that can be easily manufactured in gusseted or ungusseted form. Finally, it is an objective to provide roll mounted bags that are easily opened after dispensing and that are easily removed from the roll.

While some of the objectives of the present invention are disclosed in the prior art, none of the inventions found include all of the requirements identified.

SUMMARY OF THE INVENTION

The present invention addresses all of the deficiencies of plastic bag roll inventions and satisfies all of the objectives described above.

(1) A pre-cut plastic bag roll providing the desired features may be constructed from the following components. A continuous web of plastic bags formed from polyethylene material is provided. Each bag has a front wall and a rear wall. The front wall has an inner surface, an outer surface, first and second side edges, a top edge and a bottom edge. The rear wall has an inner surface, an outer surface, first and second side edges, a top edge and a bottom edge. The front wall is joined to the rear wall at their respective first and second side edges. The front wall is sealed to the rear wall adjacent at their respective bottom edges. An open mouth is located at the top edges of the front and rear walls. The front and rear walls of each of the bags is removably attached by a perforation line at the bottom edges to the top edges of a subsequent bag in the web. The perforation line has a first end and a second end. The perforation line is slit inwardly from at least one of the first and second ends for a first predetermined distance. The web is rolled to form a bag roll.

(2) In a variant of the invention, a chisel cut is provided. The chisel cut extends through a center point of the perforation line of the web. When the roll is installed in a bag dispenser the chisel cut will engage a separating tongue when bags are pulled from the roll.

(3) In another variant, the web is rolled about a core.

(4) In still another variant, the bags have at least one side gusset. The side gusset extends inwardly from either of the first and second side edges of the front and rear walls.

(5) In a further variant, the side gusset extends inwardly from either of the first and second side edges of the front and rear walls for up to one third of a width of the bags.

(6) In still a further variant, the side gusset extends inwardly from either of the first and second side edges of the front and rear walls for up to one half of a width of the bags.

(7) In yet a further variant, the outer surface of at least one of the front wall and the rear wall of the bags is corona treated.

(8) In still a further variant, the corona treatment of the outer surface of at least one of the front and rear walls of each of the bags is an amount sufficient to result in a surface tension on the wall of at least about 38 dynes/cm.

(9) In another variant of the invention, the outer surface of at least one of the front wall and the rear wall of the bags is printed.

(10) In still another variant, a method of making a pre-cut plastic bag roll, has the following steps: Extruding a tube of polyethylene material. Flattening the tube to form a continuous web having upper and lower surfaces and first and second side edges. Sealing the tube perpendicular to the first and second side edges at predetermined intervals to form bag bottoms. Perforating the continuous web perpendicular to the first and second side edges to form a perforation line where the perforation line has a first end and a second end. Slitting the perforation line inwardly from at least one of the first and second ends for a first predetermined distance. Rolling the web into a bag roll.

(11) In yet another variant, the method of making a pre-cut plastic bag roll includes the further step of chisel cutting the web at a center point of the perforation line prior to rolling the web into a bag roll.

(12) In still another variant, the method of making a pre-cut plastic bag roll includes the further step of providing a bag roll core prior to rolling the web into a bag roll.

(13) In a further variant the method of making pre-cut plastic bag roll includes the further step of gusseting the tube of polyethylene material prior to flattening the tube to form a continuous web.

(14) In still a further variant, the method of making a pre-cut plastic bag roll includes the further step of corona treating at least one of the upper and lower surfaces of the continuous web prior to sealing the tube perpendicular to the first and second side edges.

(15) In another variant of the invention, the method of making a pre-cut plastic bag roll includes the further step of printing either of the upper and lower surfaces of the continuous web after corona treatment.

(16) In still another variant, an apparatus for making a pre-cut plastic bag roll includes the following components. A supply of polyethylene material is provided. An extruder is provided. The extruder forms a continuous tube of thin film polyethylene. A tubing flattener is provided. The flattener flattens the continuous tube into a continuous bag web. A sealer is provided. The sealer forms a series of seals in the bag web perpendicular to a long axis of the web. A perforator is provided. The perforator perforates the bag web through two film layers and forms a perforation line and a slit. A bag roller is provided. The bag roller rolls the perforated bag web into a compact roll.

(17) In yet another variant, the apparatus includes a chisel cutter. The chisel cutter forms a chisel cut through the two film layers at a center point of the perforation line.

(18) In a further variant, the apparatus includes a supply of cores. The bag web is wound around the cores to form the bag rolls.

(19) In still a further variant, the apparatus includes a gusseter. The gusseter forms at least one side gusset in the continuous tube prior to flattening.

(20) In still a further variant of the invention, the apparatus includes a corona treater. The corona treater corona treats at least one of the upper and lower surfaces of the continuous bag web prior to rolling.

(21) In a final variant, the apparatus includes a printer. The printer prints on at least one of the upper and lower surfaces of the continuous bag web after corona treatment.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1, 3 and 4 illustrate a pre-cut plastic bag roll 10 providing the desired features that may be constructed from the following components. A continuous web 15 of plastic bags 20 formed from polyethylene material is provided. Each bag 20 has a front wall 25 and a rear wall 30. The front wall 25 has an inner surface 35, an outer surface 40, first 45 and second 50 side edges, a top edge 55 and a bottom edge 60. The rear wall 30 has an inner surface 65, an outer surface 70, first 75 and second 80 side edges, a top edge 85 and a bottom edge 90. The front wall 25 is joined to the rear wall 30 at their respective first 45, 75 and second 50, 80 side edges. The front wall 25 is sealed to the rear wall 30 adjacent at their respective bottom edges 60, 90. An open mouth 95 is located at the top edges 55, 85 of the front 25 and rear 30 walls. The front 25 and rear 30 walls of each of the bags 20 is removably attached by a perforation line 100 at the bottom edges 60, 90 to the top edges 55, 85 of a subsequent bag 20 in the web 15. The perforation line 100 has a first end 105 and a second end 110. The perforation line 100 is slit inwardly from at least one of the first 105 and second 110 ends for a first predetermined distance 115. The web 15 is rolled to form a bag roll 10.

Figure 1:
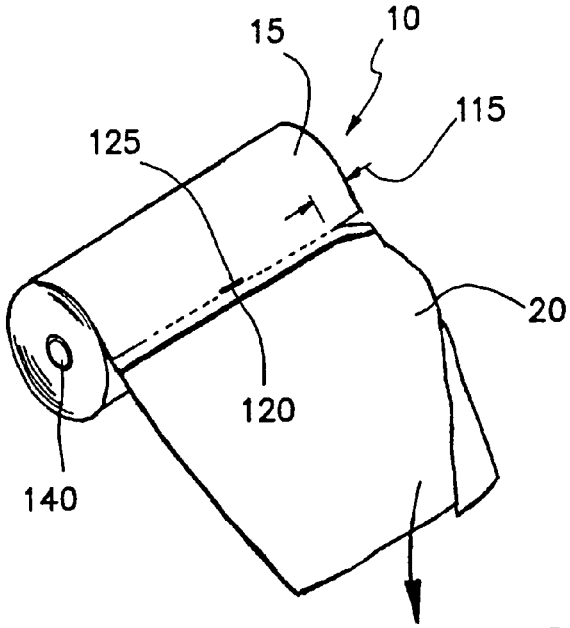
FIG. 1 is a perspective view of the bag roll of the preferred embodiment of the invention illustrating the cut at at least one end of the perforation line.
Figure 3:
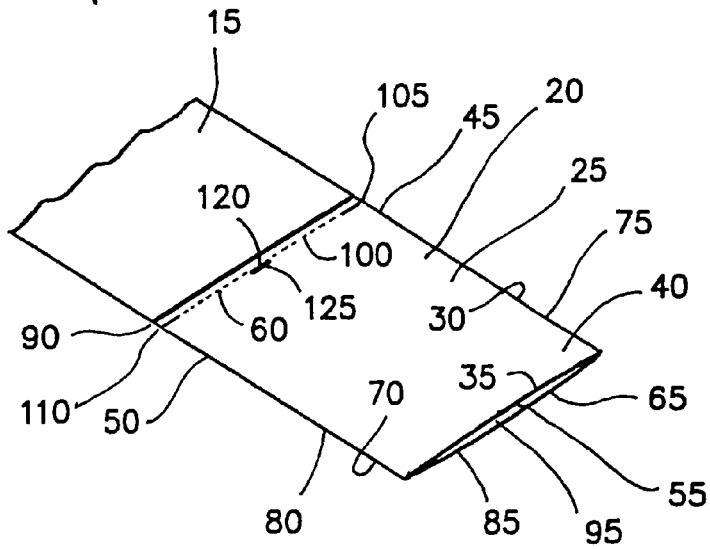
FIG. 3 is a perspective view of the FIG. 1 embodiment illustrating the bag opening.

(2) In a variant of the invention, a chisel cut 120 is provided. The chisel cut 120 extends through a center point 125 of the perforation line 100 of the web 15. When the roll 10 is installed in a bag dispenser (not shown) the chisel cut 120 will engage a separating tongue (not shown) when bags 20 are pulled from the roll 10.

(3) In another variant, the web 15 is rolled about a core 140.

Figure 6:
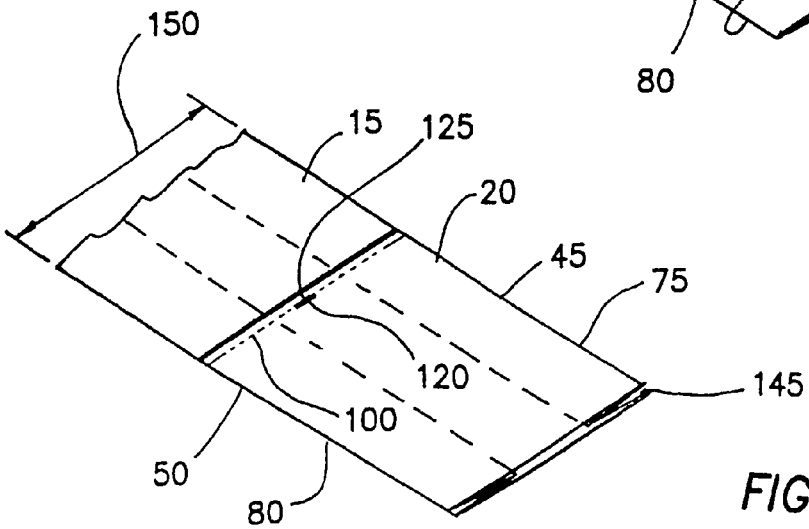
FIG. 6 is a perspective view of the FIG. 5 embodiment illustrating the bag opening and side gussets.

(4) In still another variant, as illustrated in FIG. 6, the bags 20 have at least one side gusset 145. The side gusset 145 extends inwardly from either of the first 45, 75 and second 50, 80 side edges of the front 25 and rear 30 walls.

(5) In a further variant, the side gusset 145 extends inwardly from either of the first 45, 75 and second 50, 80 side edges of the front 25 and rear 30 walls for up to one third of a width 150 of the bags 20.

(6) In still a further variant, the side gusset 145 extends inwardly from either of the first 45, 75 and second 50, 80 side edges of the front 25 and rear 30 walls for up to one half of a width 150 of the bags 20.

(7) In yet a further variant, the outer surface 40, 70 of at least one of the front wall 25 and the rear wall 30 of the bags 20 is corona treated.

(8) In still a further variant, the corona treatment of the outer surface 40, 70 of at least one of the front 25 and rear 30 walls of each of the bags 20 is an amount sufficient to result in a surface tension on the wall 25, 30 of at least about 38 dynes/cm.

(9) In another variant of the invention, the outer surface 40, 70 of at least one of the front wall 25 and the rear wall 30 of the bags 20 is printed.

Figures 2, 4:
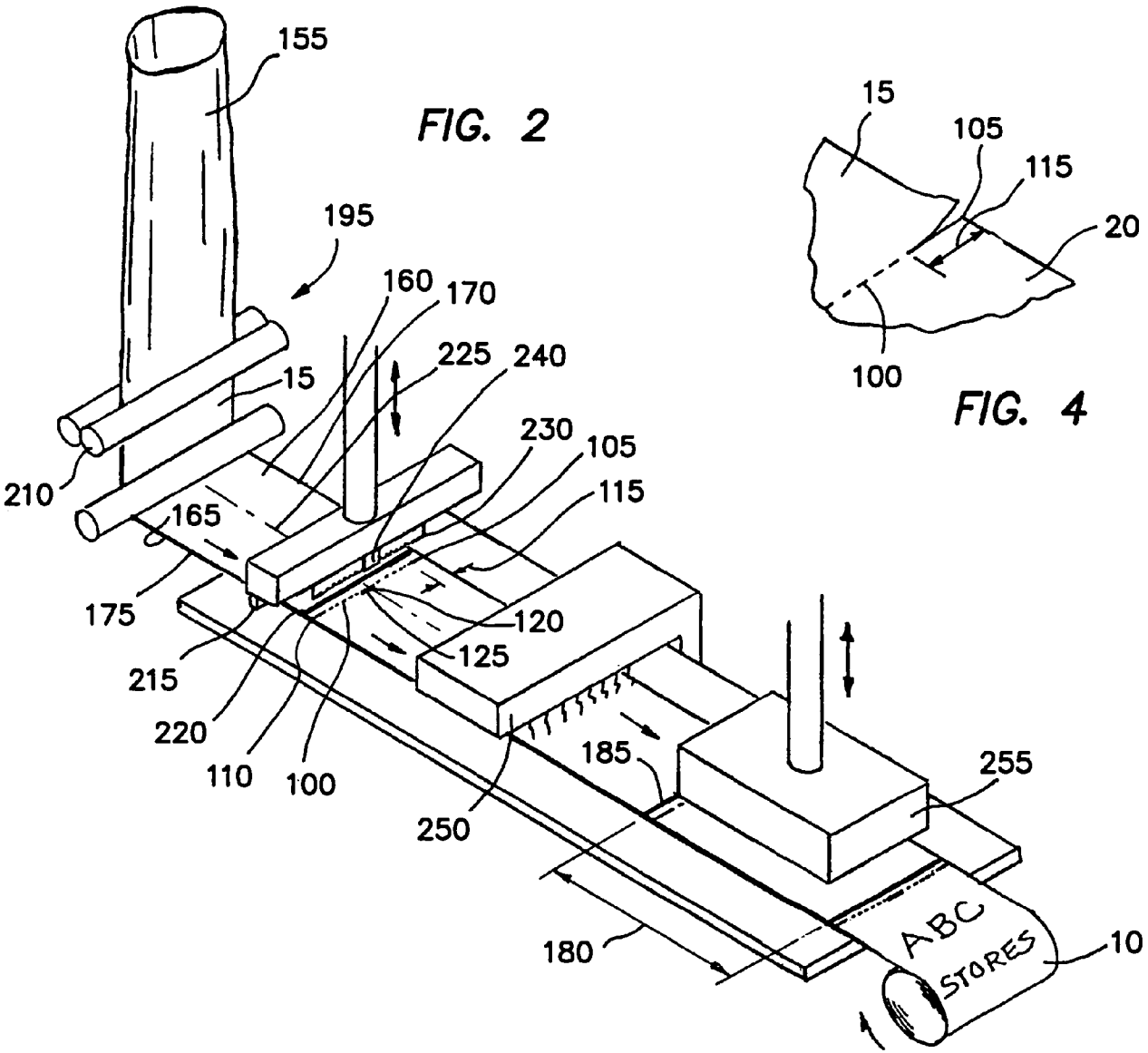
FIG. 2 is a perspective view of an apparatus for making the FIG. 1 embodiment.
FIG. 4 is a perspective view of a detail of the FIG. 1 embodiment illustrating cut at at least one end of the perforation line.
Figure 5:
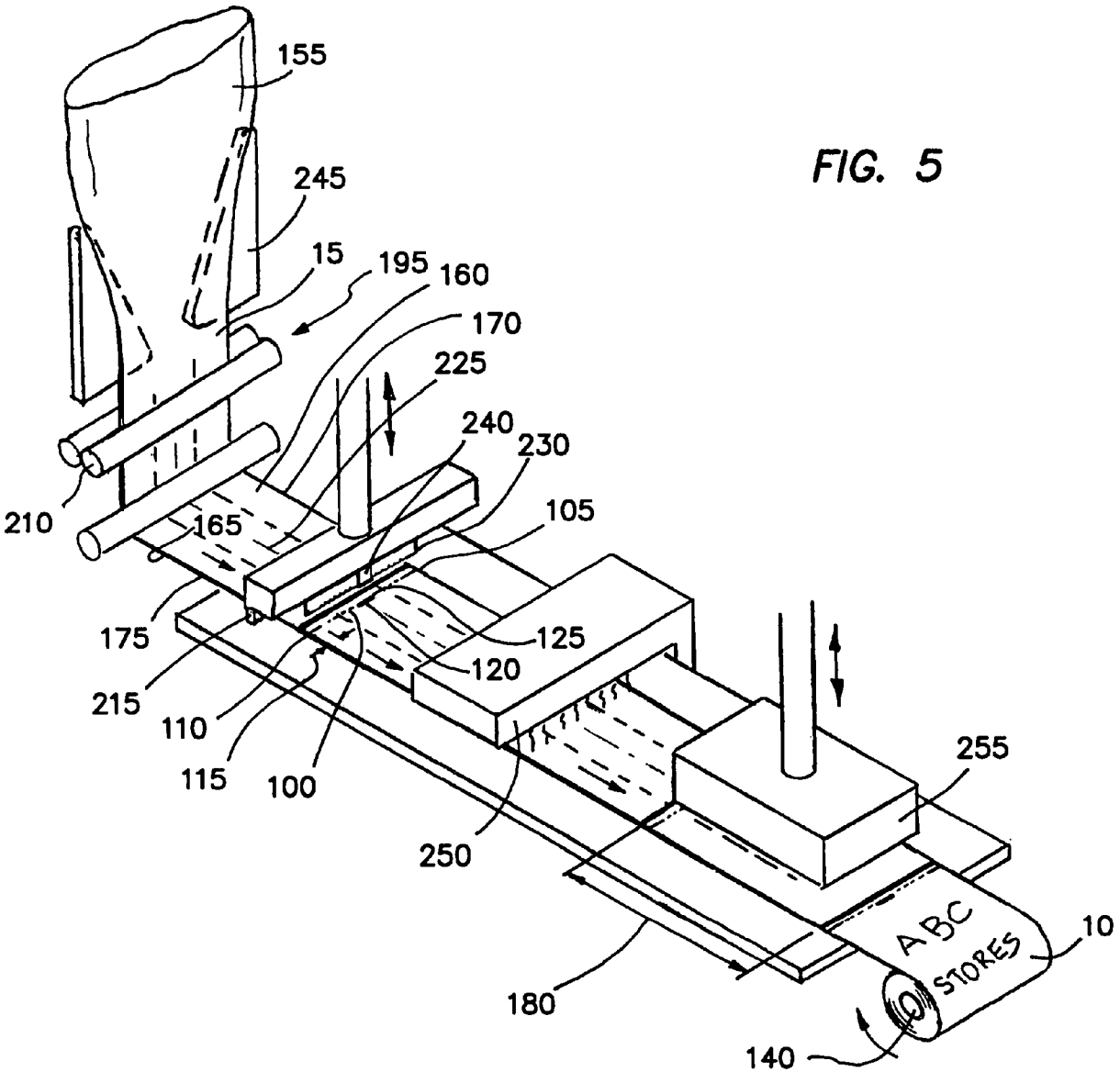
FIG. 5 is a perspective view of an apparatus for making a second, gusseted embodiment of the pre-cut bag.

(10) In still another variant, as illustrated in FIGS. 2 and 5, a method of making a pre-cut plastic bag roll 10, has the following steps: Extruding a tube 155 of polyethylene material. Flattening the tube 155 to form a continuous web 15 having upper 160 and lower 165 surfaces and first 170 and second 175 side edges. Sealing the tube 155 perpendicular to the first 170 and second 175 side edges at predetermined intervals 180 to form bag bottoms 185. Perforating the continuous web 15 perpendicular to the first 170 and second 175 side edges to form a perforation line 100 where the perforation line 100 has a first end 105 and a second end 110. Slitting the perforation line 100 inwardly from at least one of the first 105 and second 110 ends for a first predetermined distance 115. Rolling the web 15 into a bag roll 10.

(11) In yet another variant, the method of making a pre-cut plastic bag roll 10 includes the further step of chisel cutting the web 15 at a center point 125 of the perforation line 100 prior to rolling the web 15 into a bag roll 10.

(12) In still another variant, the method of making a pre-cut plastic bag roll 10 includes the further step of providing a bag roll core 140 prior to rolling the web 15 into a bag roll 10.

(13) In a further variant, the method of making pre-cut plastic bag roll 10 includes the further step of gusseting the tube 155 of polyethylene material prior to flattening the tube 155 to form a continuous web 15.

(14) In still a further variant, the method of making a pre-cut plastic bag roll 10 includes the further step of corona treating at least one of the upper 160 and lower 165 surfaces of the continuous web 15 prior to sealing the tube 155 perpendicular to the first 170 and second 175 side edges.

(15) In another variant of the invention, the method of making a pre-cut plastic bag roll 10 includes the further step of printing either of the upper 160 and lower 165 surfaces of the continuous web 15 after corona treatment.

(16) In still another variant, an apparatus 195 for making a pre-cut plastic bag roll 10 includes the following components. A supply of polyethylene material (not shown) is provided. An extruder (not shown) is provided. The extruder forms a continuous tube 155 of thin film polyethylene. A tubing flattener 210 is provided. The flattener 210 flattens the continuous tube 155 into a continuous bag web 15. A sealer 215 is provided. The sealer 215 forms a series of seals 220 in the bag web 15 perpendicular to a long axis 225 of the web 15. A perforator 230 is provided. The perforator 230 perforates and slits the bag web 15 through two film layers 25, 30 and forms a perforation line 100 and a slit 105. A bag roller (not shown) is provided. The bag roller rolls the perforated bag web 15 into a compact roll 10.

(17) In yet another variant, the apparatus 195 includes a chisel cutter 240. The chisel cutter 240 forms a chisel cut 120 through the two film layers 25, 30 at a center point 125 of the perforation line 100.

(18) In a further variant, the apparatus 195 includes a supply of cores 140. The bag web 15 is wound around the cores 140 to form the bag rolls 10.

(19) In still a further variant, the apparatus includes a gusseter 245. The gusseter 245 forms at least one side gusset 145 in the continuous tube 155 prior to flattening.

(20) In still a further variant of the invention, the apparatus 195 includes a corona treater 250. The corona treater 250 corona treats at least one of the upper 160 and lower 165 surfaces of the continuous bag web 15 prior to rolling.

(21) In a final variant, the apparatus 195 includes a printer 255. The printer 255 prints on at least one of the upper 160 and lower 165 surfaces of the continuous bag web 15 after corona treatment.

The pre-cut plastic bag roll 10, method and apparatus 195 have been described with reference to particular embodiments. Other modifications and enhancements can be made without departing from the spirit and scope of the claims that follow.

The invention claimed is:

1. A pre-cut plastic bag roll, comprising:

a continuous web of plastic bags formed from polyethylene material, each of said bags comprising:

a front wall, said front wall having an inner surface, an outer surface, first and second side edges, a top edge and a bottom edge;

a rear wall, said rear wall having an inner surface, an outer surface, first and second side edges, a top edge and a bottom edge;

said front wall being joined to said rear wall at respective first and second side edges thereof;

said front wall being sealed to said rear wall adjacent respective bottom edges thereof;

an open mouth disposed at said top edges; said front and rear walls of each of said bags being removably attached by a front straight perforation line at said bottom edge to said top edge of the front wall of a subsequent bag in said web and a rear straight perforation line at said bottom edge to said top edge of the rear wall of a subsequent bag in said web, said front straight perforation line having a front first end and a front second end; said rear straight perforation line having a rear first end and a rear second end; said front and rear straight perforation lines being in registration with each other;

said front perforation line being slit inwardly from at least one of said front first and second ends for a first predetermined distance; said predetermined distance being greater than the length of a single perforatiom said rear perforation line being slit inwardly from said at least one of said rear first and second ends for said first predetermined distance; and said web being rolled to form a bag roll.

2. The pre-cut plastic bag roll, as described in claim 1, further comprising:

a chisel cut, said chisel cut extending through a center point of said front straight perforation line and a center point of said rear straight perforation line of said web; and whereby, when said roll is installed in a bag dispenser said chisel cut will engage a separating tongue when bags are pulled from said roll.

3. The pre-cut plastic bag roll, as described in claim 1, wherein said web is rolled about a core.

4. The pre-cut plastic bag roll, as described in claim 1, further comprising at least one side gusset, said side gusset extending inwardly from either of said first and second side edges of said front and rear walls.

5. The pre-cut plastic bag roll, as described in claim 4, wherein said side gusset extends inwardly from either of said first and second side edges of said front and rear walls for up to one third of a width of said bags.

6. The pre-cut plastic bag roll, as described in claim 4, wherein said side gusset extends inwardly from either of said first and second side edges of said front and rear walls for up to one half of said a of said bags.

7. The pre-cut plastic bag roll, as described in claim 1, wherein said outer surface of at least one of said front wall and said rear wall of said bags is corona treated.

8. The pre-cut plastic bag roll, as described in claim 7, wherein said corona treatment of said outer surface of at least one of said front and rear walls of each of said bags is an amount sufficient to result in a surface tension on said wall of at least about 38 dynes/cm.

9. The pre-cut plastic bag roll, as described in claim 7, wherein said outer surface of at least one of said front wall and said rear wall of said bags is printed.

* * * * *